United States Patent [19]

Brock

[11] 4,408,355

[45] Oct. 11, 1983

[54] HAND WARMER

[76] Inventor: Kenneth Brock, R.R. #2, Albion, Ind. 46701

[21] Appl. No.: 443,061

[22] Filed: Nov. 19, 1982

[51] Int. Cl.[3] ..... D04B 7/04

[52] U.S. Cl. ..... 2/66

[58] Field of Search ..... 2/66

[56] References Cited

U.S. PATENT DOCUMENTS

| | | | |
|---|---|---|---|
| 25,189 | 2/1896 | McMahon | 2/66 |
| 1,007,922 | 11/1911 | Cohen | 2/66 |
| 2,298,600 | 10/1942 | Stember | 2/66 |
| 2,351,158 | 6/1944 | Stelzer | 2/66 |
| 2,727,241 | 12/1955 | Smith | 2/66 |
| 2,835,896 | 5/1958 | Giese | 2/66 |
| 3,793,643 | 2/1974 | Kinoshita | 2/66 |

*Primary Examiner*—Doris L. Troutman

*Attorney, Agent, or Firm*—K. S. Cornaby

[57] ABSTRACT

A hand warmer is provided which tightly fits against the waist of the user by means of an adjustable belt, and which substantially conforms to the curvature of the body. An elastic band is disposed in the interior of the muff for holding a heat source device therein, and means are provided at each end opening of the muff for selectively varying the size thereof between fully open and fully closed.

6 Claims, 5 Drawing Figures

HAND WARMER

BACKGROUND OF THE INVENTION

This invention pertains to a hand warmer for use in cold environments, especially for outdoor sportsmen.

Many kinds of hand warmers or muffs are available, some being designed for formal clothing, others for outdoor sports clothing. The hand warmer of the present invention is intended to be worn as part of outdoor sports clothing and is an improvement upon those hand warmers which have various straps or strings for the wearing or use thereof.

Quite clearly, hand warmers intended to be used in cold environments are cumbersome if they have too many straps or strings. A well knwon fact of cold weather activities is decreasing manual dexterity with increasing numbness of hands and fingers.

Another disadvantage with some hand warmers is their sole dependence on the body heat of the user to keep the hands warm. This may be adequate for cool temperatures or dry limbs, but is generally inadequate for colder temperatures or wet limbs. For example, an ice fisherman exposed to falling snow and who must continually dip a hand into a fishing hole to prevent it from freezing over would have a difficult time warming wet, cold hands.

SUMMARY OF THE INVENTION

The present invention overcomes the above disadvantages by providing a hand warmer that utilizes only a single adjustable belt with which the user attaches the hand warmer about his waist. No further straps, belts, strings, or the like are associated with the hand warmer, thereby eliminating obstructions to a user, particularly hunters and fishermen.

The main body or muff of the hand warmer has end portions which diverge outwardly from the outer edge thereof toward the waist of the user to substantially conform thereto. This tends to eliminate the possibility of any equipment being hung up or otherwise obstructed, for example, shoulder straps of weapons or fishing lines.

Another distinct advantage of the present invention is the use of Velcro material as the means for varying the size of the end openings of the muff. The openings may be either fully opened, fully closed to prevent entry of any moisture into the interior thereof, or partially closed to fit the hand size of the user. This easily permits the user to adjust the openings without having to manipulate strings or lines, which is especially beneficial should the user have cold, numb fingers.

A further advantageous feature of the present invention is the provision of an elastic band in the interior of the muff for removably holding a heat source device. By so providing, the hand warmer does not depend solely upon the body heat of the user to warm the hands and fingers, but is aided by the heat generated by the heat source device.

Broadly stated, one embodiment of the present invention provides a hand warming device for cold environments comprising a muff having end openings and being made of a plurality of layers of material, wherein the outer layer is a water repellent material and an inner layer is an insulating material. An elastic band is disposed in the interior of the muff to removably hold therein a heat source device for assisting in warming the hands of the user. The end openings of the hand warmers may be selectively varied between fully open and fully closed, and an adjustable belt is attached to the muff to secure it to the body of the user.

BRIEF DESCRIPTION OF THE DRAWINGS

The above mentioned and other features and objects of the present invention, and the manner of attaining them, will become more apparent and the invention itself will be better understood by reference to the following description of an embodiment of the invention taken in conjunction with the accompanying drawings, wherein.

DESCRIPTION OF A PREFERRED EMBODIMENT

Figure 1:
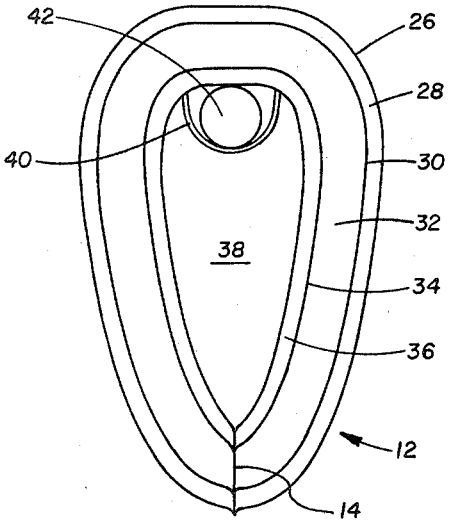
FIG. 1 is a sectional view of FIG. 2 with the belt removed and taken along line 1—1.
Figure 2:
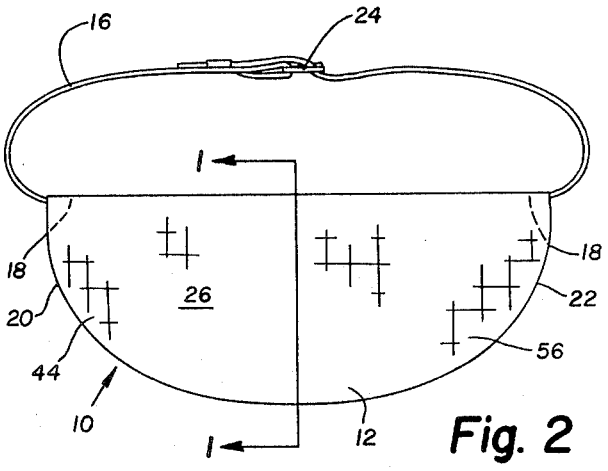
FIG. 2 is a top plan view of a preferred embodiment.

Referring to the figures, hand warmer 10 comprises a muff 12 constructed of several layers of material sewn together along seam 14, and an adjustable belt 16 having its ends 18 sewn to muff 12 adjacent end openings 20,22. A suitable buckle 24 is provided with belt 16 so that adjustments may be made thereto in accordance with the clothing worn by the user.

Referring to FIG. 1, muff 12 has outer cover 26 made of a water repellent material, for example, nylon material, and may have a camouflage design thereon. First interlayer 28 is made of a thermal insulating material and is disposed between outer cover 26 and second interlayer 30, which is preferably a nylon material. The thermal insulation material of which first interlayer 28 may be made from a material similar to thermal underwear.

Third interlayer 32 is made of a foam-type insulating padding having a depth of approximately three-quarters of an inch of a flexibly stiff nature so as to provide a certain degree of stiffness to muff 12. This is to allow the user to insert only one hand into muff 12 without having to use the other hand to support or hold muff 12 during the insertion.

Fourth interlayer 34 is made of a nylon material, and innermost layer 36 is an insulating material, for example, thermal underwear, sheepskin lining, or the like.

In constructing muff 12, cover 26 and layers 28–36, which are of oval shape, are folded over and sewn together along seam 14. Ends 18 of belt 16 may be sewn to muff 12 at any of the layers 28–36, and preferably to at least one of the nylon layers 26,30, or 34.

Innermost layer 36 defines interior 38 of muff 12 and has elastic band 40 sewn thereto for holding a heat source 42 therein. Heat source 42 provides additional means of warming the user's hands and is especially desirable if the user is engaged in activities that require or cause his hands to become both cold and wet.

Figure 3:
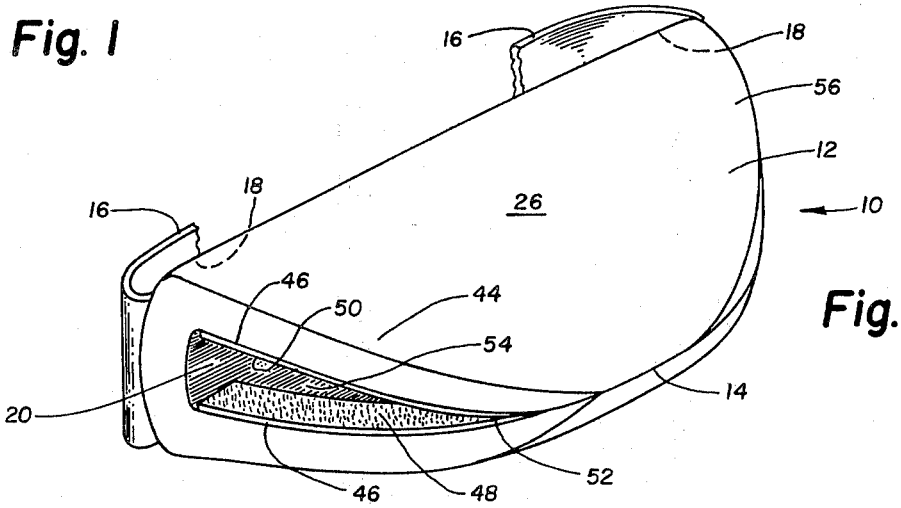
FIG. 3 is an enlarged, fragmentary view in perspective of one end portion of the embodiment of FIG. 2.

FIG. 3 illustrates an end portion 44 of muff 12 and the means of selectively varying the size of end opening 20, as well as opposite end opening 22; only opening 20 being illustrated and described here for purposes of clarity. End opening 20 has a periphery 46 with two narrow strips of material sewn thereto. First strip 48 lines approximately half the length of periphery 46 and has on its outer surface a plurality of minute loop members, and second strip 50 lines the remaining portion of periphery 46 and has on its outer surface a plurality of minute hook members (not shown), which are engageable with the loop members of first strip 48. A suitable material for first strip 48 and second strip 50 is VELCRO material.

The size of end opening 20 may then be selectively varied by the user without having to manipulate any strings or chords, which is extremely difficult if the fingers are numb. In the instant case, the user merely has to contact portions of first strip 48 and second strip 50 together to attach them to adjust the size of end opening 20. FIG. 3 illustrates a closed portion 52 and an open portion 54 of end opening 20.

Figure 4:
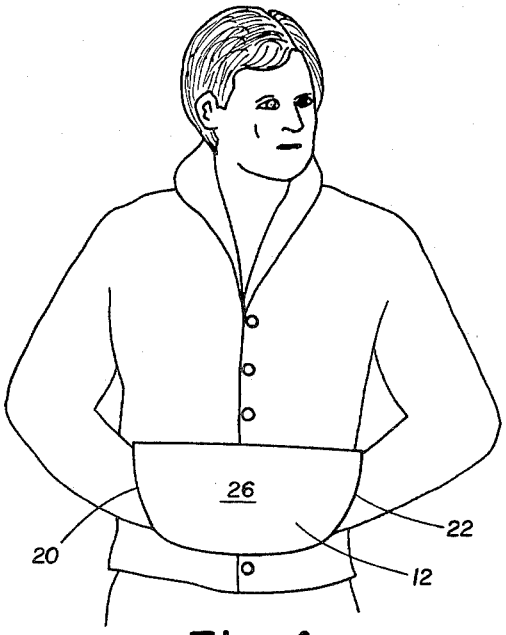
FIG. 4 is a front elevational view of the embodiment of FIG. 2 as worn by a user.
Figure 5:
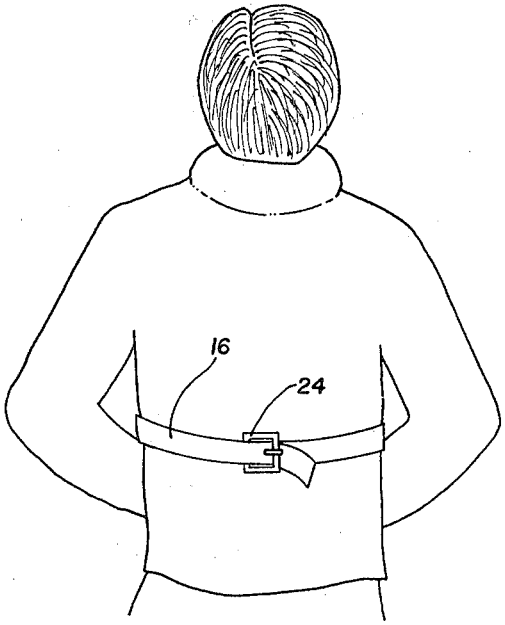
FIG. 5 is a rear elevational view of the user in FIG. 4.

Referring to FIGS. 4 and 5, hand warmer 10 is illustrated as it would be normally worn by a user. Adjustable belt 16 permits the user to firmly attach muff 12 against his waist, and, because end portions 44,56 diverge outwardly from seam 14 toward his waste (FIG. 3), the chances of equipment entanglement are reduced.

While the attachments of the various layers 26–36 and adjustable belt 16 have been described in terms of being sewn together, other suitable securement means are acceptable.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A hand warming device for cold environments, comprising:

a muff having end openings and being made of a plurality of layers of material, the outer layer thereof being a water repellent material, and an inner layer thereof being an insulating material, an elastic band member disposed in the interior of said muff and adapted to removably hold therein a heat source for warming the hands of the user, closing means at each said end opening for selectively varying the size thereof between fully open and fully closed, and an adjustable belt attached to said muff to secure said muff against a body portion of the user.

2. The device of claim 1 wherein said inner layer insulating material is of a flexible semi-rigid nature to substantially maintain the shape of said muff.

3. The device of claim 1 wherein each said closing means at a respective said end opening includes a narrow strip of a first material lining a peripheral portion of said end opening, and a narrow strip of a second material lining the remaining peripheral portion of said end opening, said first material strip having on its outer surface a plurality of minute loop members and said second material having on its outer surface a plurality of minute hook members engageable with said loop members, whereby said end openings may be selectively varied between fully open and fully closed by bringing into engagement selected portions of said first and second material strips.

4. The device of claim 1 wherein said outer layer is a nylon material.

5. The device of claim 1 wherein said muff has an outer edge extending between said end portions thereof, and said end portions diverge outwardly from said outer edge toward the body portion of the user to substantially conform to the curvature thereof.

6. The device of claim 1 wherein said muff outer layer is a nylon material and said muff inner layer insulating material is of a flexible semi-rigid nature, said muff has an outer edge extending between said end portions thereof and said end portions diverge outwardly from said outer edge toward the body of the user to substantially conform to the curvature thereof, and wherein each said closing means at a respective said end opening includes a narrow strip of a first material lining a peripheral portion of said end opening, and a narrow strip of a second material lining the remaining peripheral portion of said end opening, said first material strip having on its outer surface a plurality of minute loop members and said second material having on its outer surface a plurality of minute hook members engageable with said loop members, whereby said end openings may be selectively varied between fully open and fully closed by bringing into engagement selected portions of said first and second material strips.

* * * * *